US006595868B1

(12) United States Patent
Androlia

(10) Patent No.: US 6,595,868 B1
(45) Date of Patent: Jul. 22, 2003

(54) FILLED ARROW SHAFT AND METHOD OF MAKING SAME

(76) Inventor: William Louis Androlia, 28779 Sea Ranch Way, Malibu, CA (US) 90265

( * ) Notice: Subject to any disclaimer, the term of this patent is extended or adjusted under 35 U.S.C. 154(b) by 437 days.

(21) Appl. No.: 08/856,360

(22) Filed: May 14, 1997

(51) Int. Cl.[7] ..... A63B 65/02; A63B 53/12
(52) U.S. Cl. ..... 473/318; 473/578
(58) Field of Search ..... 473/316–323, 473/580, 581, 578, 569

(56) References Cited

U.S. PATENT DOCUMENTS 1,999,601 A * 4/1935 Tengel ..... 473/578
2,992,828 A * 7/1961 Stewart ..... 473/316
3,461,593 A * 8/1969 Martuch ..... 473/318
3,746,204 A * 7/1973 Nagai ..... 220/445
3,873,392 A * 3/1975 Niebylski ..... 428/141
4,204,684 A * 5/1980 Molitor ..... 473/349
4,410,183 A * 10/1983 Miller ..... 473/578
4,706,965 A * 11/1987 Schaar ..... 473/578
5,547,189 A * 8/1996 Billings ..... 473/316
5,586,948 A * 12/1996 Mick ..... 473/332

* cited by examiner

*Primary Examiner*—Stephen Blau
(74) *Attorney, Agent, or Firm*—Koda & Androlia

(57) ABSTRACT

A filled shaft for an arrow. The filled shaft includes an elongated cylindrical tube and at least one foamed resin filling substantially the elongated cylindrical tube from end to end. The shaft may further include a lightweight, thin insert in the foamed resin and extending the length of the elongated cylindrical tube.

7 Claims, 1 Drawing Sheet

FILLED ARROW SHAFT AND METHOD OF MAKING SAME

BACKGROUND OF THE INVENTION

1. Field of the Invention

The present invention relates to shafts and particularly shafts for use in arrows.

2. Prior Art

In the prior art there exists several different methods for making shafts. The earliest method of shaft manufacturing was to make cylindrical solid wooden shafts. Shafts were later produced out of plastic, fiber glass, carbon fiber, aluminum tubing and composite materials made of two or more dissimilar materials, e.g., particularly thin wall aluminum tubing with carbon fiber overlaid and bonded thereto.

Shafts used for arrows require that they be designed and constructed for particular stiffnesses. Indeed, in many applications, the stiffer the better. To achieve this higher stiffness without resorting to very heavy construction, composite materials, and particularly thin-wall aluminum tubing with carbon fiber overlaid and bonded thereto, have been adopted. While this construction is capable of providing sufficient stiffness in varying amounts, these types of shafts are often very expensive.

Arrows have additional characteristics which are different as compared to shafts for golf clubs. In particular, arrows must be able to provide the required stiffness while being light in weight and small in diameter. The lightness of the weight of the arrow allows the arrow to be shot faster in a flatter trajectory; the small diameter reduces the wind drag, which means that the arrow will retain more of its speed over long distances and be less affected by cross winds. Again, the construction that has been adopted is that of composite construction consisting of thin-walled aluminum tubing with carbon fiber overlaid and bonded thereto. While such a composite structure can provide the required stiffness with small diameter and lightweight, it is again expensive and difficult to manufacture.

SUMMARY OF THE INVENTION

Accordingly, it is a general object of the present invention to provide a shaft which overcomes the disadvantages of the prior art.

In particular, it is an object of the present invention to provide a shaft which can be made stiff, low in weight and small in diameter while being manufactured for a reasonable cost.

In view of the objects set forth above, the present invention comprises a filled shaft and a method for making the filled shaft. In particular, the shaft includes a cylindrical tube and at least one foamed resin filling the cylindrical tube. Preferably the cylindrical tube is made from a thin-wall aluminum tubing and the foamed resin comprises a foam polystyrene resin, commonly called styrofoam. The polystyrene resin is injected as a liquid into the cylindrical tube in an amount sufficient to fill the entire cylindrical tube once the styrene resin foams up and solidifies.

BRIEF DESCRIPTION OF THE DRAWINGS

The present invention will be described in terms of the attached figures wherein like reference numerals denote like elements and in which.

DETAILED DESCRIPTION OF THE INVENTION

Figure 1:
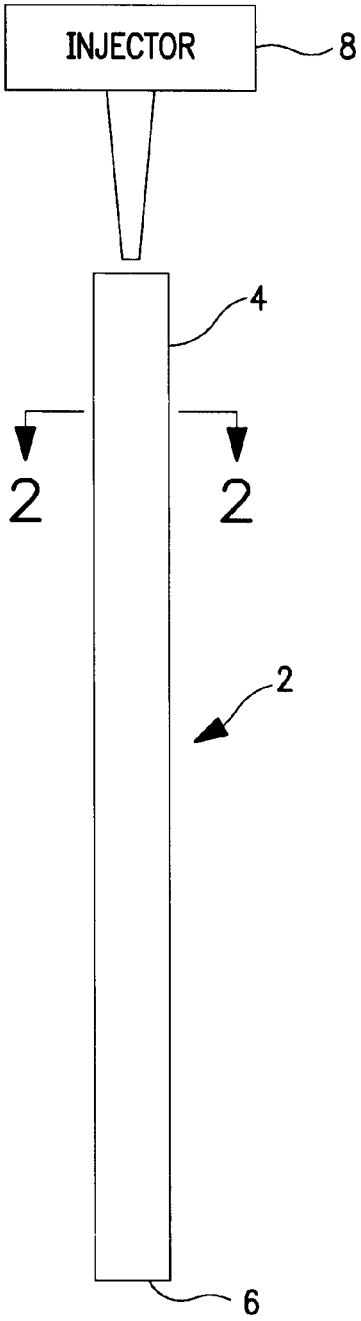
FIG. 1 is a simplified view illustrating the method of manufacturing the shaft of the present invention.

Referring the FIGS. 1 and 2, a first embodiment of the present invention will be described. The filled arrow 2 comprises a cylindrical hollow tube 4. The cylindrical hollow tube 4 can be made of any one of a number of suitable materials such as thin wall aluminum tubing, carbon fiber or a composite material. Preferably from the point of view of cost, the tube 4 should be made from a thin wall aluminum tubing which is made from an aluminum alloy such as 7178-T9 or 7075-T9. One end 6 of the cylindrical hollow tube 4 is closed and at least one suitable foaming resin is injected by the injector 8 into the cylindrical hollow tube 4. A sufficient amount of the foaming resin is injected into the cylindrical hollow tube 4 to ensure that the cylindrical hollow tube 4 is substantially filled once the foaming resin has completely foamed and hardened. The injected foaming resin when once hardened forms a filling core 10 with voids 12. Suitable foaming resins are well known and can be selected from polyurethanes, polystyrenes, polyvinyls, polyethylenes, silicones and epoxies.

It should be apparent that the weight and stiffness of the shaft can be varied by varying several parameters or characteristics. In particular, the diameter and wall thickness of the cylindrical hollow tube 4 may be varied and the size of the voids 12 and the degree of hardness and/or polymerization of the foamed resin may be varied. By increasing the diameter and the wall thickness of the cylindrical hollow tube 4, the stiffness is generally increased. Similarly, by making the voids 12 smaller and the foamed resin harder, the stiffness would be increased. The manner of mixing, the proportions chosen for the foaming resin and the use of blowing agents to achieve different hardnesses and flexibility and different sized voids is well known to those skilled in the art. Therefore, the various characteristics and parameters may be varied to achieve a shaft of the desired diameter, stiffness and weight.

Figure 3:
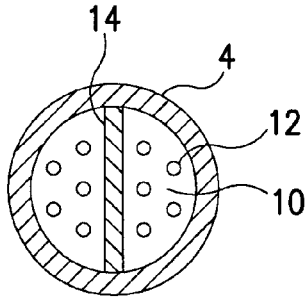
FIG. 3 is a cross section similar to FIG. 2 illustrating a second embodiment of the present invention.

Referring the FIG. 3, shown therein is a second embodiment of the present invention. In this embodiment, similar elements are given the same reference numerals and function in the same way as it did in the first embodiment.

In the shaft of the second embodiment of FIG. 3, it might be required that additional stiffness beyond that which can be achieved by just providing the filling core 10 is desired. In this case, a thin, rectangular piece of material 14 is inserted into the cylindrical hollow tube 4 before the foaming resin is injected. The rectangular piece 14 extends the fill length of the cylindrical hollow tube 4 and can be made from any suitable materials such as a metal foil or plastic film.

Figure 2:
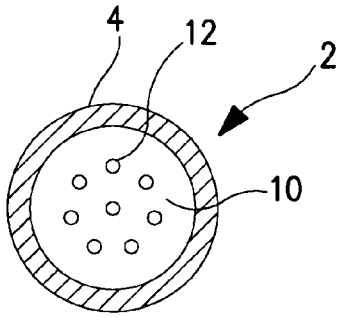
FIG. 2 is a cross section along the lines 2—2 in FIG. 1 illustrating the internal construction of a shaft made in accordance with the teachings of the present invention.
Figure 4:
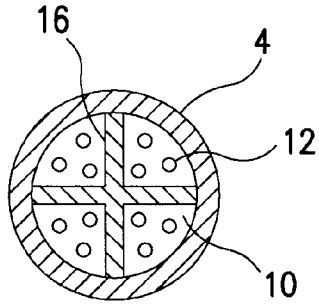
FIG. 4 is a cross section similar to FIG. 2 illustrating a third embodiment of the present invention.

Referring to FIG. 4, shown therein is a third embodiment which is similar to the embodiments of FIGS. 2 and 3 and in which like reference numerals denote like elements and function substantially the same.

However, in the third embodiment of FIG. 4, a shaft with even more stiffness might be required. Accordingly, to achieve this even higher stiffness, an insert 16 of essentially a cross section in the shape of a plus symbol is inserted into the cylindrical hollow tube 4 before the foaming resin is injected thereinto. Again, the insert 16 extends the full length of the cylindrical hollow tube 4 and is made of any suitable material such as a metal foil or plastic film.

It should be apparent to those skilled in the art that the above-described embodiments would allow one to make the arrow shaft using relatively inexpensive thin-walled aluminum tubing which is high in stiffness, small in diameter and low in weight. As a result, performance on a par with arrows made from expensive composite materials can be achieved at relatively low costs.

The above-described embodiments represent but a few of the embodiments which fall within the scope of this invention. Numerous and varied other embodiments can be devised without departing from the spirit and scope of the present invention. For example, the shaft need not be completely filled with the foamed resin. Alternately, one or more elongated foam core segments can be formed along the length of the shaft, i.e., preferably the central portion. These and other embodiments are also within the spirit and scope of this invention.

I claim:

1. An arrow shaft comprising:

an elongated cylindrical tube, said tube being small in diameter;

at least one foam-filled resin filling at least a central portion of said elongated cylindrical tube so as to increase the stiffness of the tube; and a thin rectangular insert provided substantially the length of the elongated cylindrical tube, said insert selected from the group consisting of metal foil and plastic film.

2. An arrow shaft comprising:

an elongated cylindrical tube, said tube being small in diameter;

at least one foam-filled resin fining at least a central portion of said elongated cylindrical tube so as to increase the stiffness of said tube; and an insert substantially in cross section of a plus symbol extending substantially the length of the elongated cylindrical tube, said insert being made from a material selected from the group consisting of metal foil and plastic film.

3. A method for making an arrow shaft comprising:

injecting a foaming resin into an elongated cylindrical tube, said tube being small in diameter;

allowing said foaming resin to foam to fill at least a central portion of said elongated cylindrical tube; and allowing the foaming resin to harden and/or polymerize.

4. A method for making an arrow shaft according to claim 3, wherein said foaming resin is selected from the group consisting of polystyrenes, polyurethanes, polyethylenes, polyvinyls, silicones and epoxies.

5. A method for making an arrow shaft according to claim 4, wherein said elongated cylindrical tube is made from an aluminum alloy.

6. A method for making an arrow shaft according to claim 4, further comprising the step of varying the pore size and hardness of said foaming resin to vary stiffness of said arrow shaft.

7. A method for making an arrow shaft according to claim 3, wherein said elongated cylindrical tube is made from a material selected from the group consisting of aluminum alloy tubing, carbon fiber and carbon fiber-aluminum composite.

* * * * *